United States Patent [19]

Le Coent

[11] Patent Number: 4,764,295

[45] Date of Patent: Aug. 16, 1988

[54] NON-FOAMING DETERGENT-DISPERSANT ADDITIVES FOR LUBRICATING OILS AND PROCESS FOR MAKING SUCH ADDITIVES

[75] Inventor: Jean-Louis Le Coent, Le Havre, France

[73] Assignee: Orogil, France

[21] Appl. No.: 735,788

[22] Filed: May 20, 1985

[30] Foreign Application Priority Data

May 25, 1984 [FR] France ..... 8408208

[51] Int. Cl.[4] ..... C10M 129/00; C10M 135/00

[52] U.S. Cl. ..... 252/33.2; 252/18; 252/33; 252/33.4; 252/39; 252/40.7

[58] Field of Search ..... 252/33, 18, 33.4, 35, 252/33.2, 39, 40.7

[56] References Cited

U.S. PATENT DOCUMENTS 4,086,170 4/1978 De Clippelier et al. ..... 252/33
4,137,186 1/1979 Sabol ..... 252/33
4,192,758 3/1980 Dickey et al. ..... 252/33
4,252,659 2/1981 Ali ..... 252/33
4,306,983 12/1981 Allain ..... 252/33

FOREIGN PATENT DOCUMENTS 2123022 1/1984 United Kingdom ..... 252/33
2123021 1/1984 United Kingdom ..... 252/33

*Primary Examiner*—William R. Dixon, Jr.
*Assistant Examiner*—Margaret B. Medley

[57] ABSTRACT

Disclosed are detergent-dispersant additives for lubricating oils that are made by contacting an alkylarylsulfonic acid with an alkaline earth base in the presence of an alcohol having a boiling point in excess of 80° C., water, chloride ions and preferably a $C_1$–$C_4$ carboxylic acid. The products may be made more basic by carbonation. The disclosed additives, when not carbonated, have a TBN up to about 40 and, when carbonated, have a TBN of up to about 100.

27 Claims, No Drawings

NON-FOAMING DETERGENT-DISPERSANT ADDITIVES FOR LUBRICATING OILS AND PROCESS FOR MAKING SUCH ADDITIVES

FIELD OF THE INVENTION

The present invention relates to detergent-dispersant additives for lubricating oils and to the process for making such additives. The additives of my invention, which are made from alkylarylsulfonates of alkaline earth metals, do not tend to foam irrespective of the identity of the alkylarylsulfonic acid from which the additive is made.

BACKGROUND OF THE INVENTION

Detergent-dispersant additives for lubricating oils that are said to have a reduced tendency to cause foaming are described in U.S. Pat. No. 4,235,810 and European Patent Application Publication No. 1,318. Such additives are obtained by the coalkylation of an aromatic hydrocarbon, such as benzene, toluene, or orthoxylene, with a mixture of 5–95% (preferably 95–70%) by weight of a branched $C_{15}$–$C_{40}$ olefin and 95–5% (preferably 30–5%) by weight of a linear $C_{16}$–$C_{30}$ olefin, followed by sulfonation of the coalkylate and neutralization of the resultant sulfonic acid with an alkaline earth base.

SUMMARY OF THE INVENTION

My invention relates to detergent-dispersant additives, made from alkylarylsulfonates, that do not tend to foam either during their preparation or during their use. My invention also relates to a process for making such additives. The additives of my invention exhibit their desirable characteristics irrespective of the nature of the alkyl radical or radicals of the alkylarylsulfonate from which they are made, i.e., whether the radicals are linear, branched, or partially branched.

The process of my invention includes at least the following steps:

(a) reacting, in a diluent oil, an alkylarylsulfonic acid with an alkaline earth base, the amounts of reactants used being such that the molar ratio of the alkaline earth base to the alkylarylsulfonic acid in the reaction medium is between about 0.51 and about 1.8;

(b) contacting the materials specified in step (a) (or their reaction product) with an alcohol having a boiling point above about 80° C. in the presence of water and chloride ions, with the molar ratios of the constituents being:

(i) for the chloride ion to the alkylarylsulfonic acid, between about 0.005 and about 0.2;

(ii) for the alcohol to the alkylarylsulfonic acid, greater than or equal to about 0.1; and (iii) for the water to the alkylarylsulfonic acid, between about 0.2 and about 5;

(c) removing water and alcohol from the product obtained in step (b); and (d) removing solid substances from the product obtained in step (c) (e.g., by filtration or centrifuging, preferably by filtration, particularly when practicing the process on an industrial scale).

As will be described below, preferred embodiments of my invention may include additional steps.

DESCRIPTION OF THE PREFERRED EMBODIMENTS

A preferred process for making the additives of my invention comprises the following steps:

(a) reacting, in a diluent oil, an alkylarylsulfonic acid with an alkaline earth base, the molar ratio of alkaline earth base to the alkylarylsulfonic acid being between about 0.51 and about 1.8 (most preferably between about 0.55 and about 1.6);

(b) contacting the materials specified in step (a) (or their reaction product) with an alcohol having a boiling point above about 80° C., and optionally with a carboxylic acid containing from 1 to 4 carbon atoms, in the presence of water and halide ions (preferably chloride ions), with the molar ratios of the constituents being contacted being:

(i) for the carboxylic acid to the basic alkaline earth base, between 0 and about 2 (most preferably between about 0.15 and about 1.5);

(ii) for the chloride ion to the alkylarylsulfonic acid, between about 0.005 and about 0.2 (most preferably between about 0.01 and about 0.15);

(iii) for the alcohol to the alkylarylsulfonic acid, greater than or equal to about 0.1 (most preferably between about 0.15 and about 2.5);

(iv) for the water to the alkylarylsulfonic acid, between about 0.2 and about 5 (most preferably between about 0.5 and about 4);

(c) removing water and alcohol from the product obtained in step (b); and (d) removing solid substances from the product obtained in step (c) (e.g., by filtration or centrifuging, preferably by filtration, particularly when practicing the process on an industrial scale).

In one embodiment of my invention, the mixture resulting from step (b) is carbonated with carbon dioxide before removing water and alcohol from the reaction medium. This is preferably done when the molar ratio of alkaline earth base to alkylarylsulfonic acid is at least 1.2, most preferably when that ratio is at least 1.3.

As used herein, "alkylarylsulfonic acids" shall include the acids obtained by the sulfonation of (a) a compound from the group consisting of alkylbenzene, alkylorthoxylene, alkyltoluene and mixtures thereof where the compound contains at least one alkyl radical bound to the aromatic group, said alkyl radical containing from 15 to 40 carbon atoms and being derived from linear or branched olefins or from olefin oligomers, or (b) petroleum fractions. Mixtures of alkylarylsulfonic acids may be used in my invention.

More particularly, the alkylarylsulfonic acids that may be used in the process of my invention include (1) alkylarylsulfonic acids that have a linearity percentage of approximately 100%, obtained by sulfonation of an alkylbenzene, an alkylorthoxylene, or an alkyltoluene whose "alkyl" radical or radicals are linear and mixtures of alkylbenzenes, alkylorthoxylenes, alkyltoluenes whose "alkyl" radical or radicals are linear;

(2) alkylarylsulfonic acids having a branching percentage of approximately 100%, obtained by sulfonation of an alkylbenzene, an alkylorthoxylene, or an alkyltoluene whose alkyl radical or radicals are branched, and mixtures of alkylbenzenes, alkylorthoxylenes, and alkyltoluenes whose "alkyl" radical or radicals are branched;

(3) mixtures of alkylarylsulfonic acids that are approximately 100% linear and alkylarylsulfonic acids having branched "alkyl" chains, the percentage of branched "alkyl" chains of the said mixtures being, e.g., from about 5 to about 95%; and (4) alkylarylsulfonic acids obtained by sulfonation of coalkylates obtained by coalkylation of benzene, toluene, or orthoxylene with a linear olefin and a branched olefin according to the method described in the aforementioned U.S. Pat. No. 4,235,810 and European Patent Application Publication No. 1,318.

By way of explanation, it should be noted that when prepared from linear olefins, alkylarylsulfonic acids are considered to contain a percentage of linear chains of 100%; when prepared from branched olefins, they are considered to contain a percentage of branched chains of 100%; when prepared from a mixture of linear olefins and branched olefins with a molar ratio of linear olefins/branched olefins of 1/1, the alkylarylsulfonic acids are considered to contain a percentage of branched chains of 50%; and when prepared from a mixture of linear olefins and branched olefins with a molar ratio of branched olefins/linear olefins of 3/1, they are considered to contain a percentage of branched chains of 75%.

The molecular weight of the the alkylarylsulfonic acids used in my invention, calculated as its sodium salt, is preferably between 400 to 600. The acids are preferably introduced into step (c) of my process in a non-diluted form or in the form of a solution of the acid in a diluent oil, the solution preferably containing at least about 40% by weight of the sulfonic acid.

As used herein, "basic alkaline earth base" shall mean the amount of alkaline earth base that is present in excess of the amount of alkaline earth base bound to the alkylarylsulfonic acid. This excess amount of alkaline earth base is dispersed in the reaction medium.

It is within the scope of my invention to contact some or all of the materials specified in step (b) at the same time that the reaction specified in step (a) is conducted. In other words, steps (a) and (b) may be carried out either simultaneously or sequentially. Also, the alcohol, water, halide and carboxylic acid may be added in any order. The carboxylic acid, when used, is preferably (but not necessarily) introduced after the reaction specified in step (a) is carried out.

Among the alkaline earth bases that may be used are the oxides, hydroxides, and carbonates of calcium, barium, and magnesium. Particularly preferred are lime and active magnesium oxide. As used herein, active magnesium oxide shall mean magnesium oxide with a specific surface area greater than or equal to 80 square meters/g, preferably from about 100 to about 170 square meters/g. "Maglite DE", a product having a specific surface area of about 140 square meters/g marketed by Merck and Co., may be used in my invention.

Among the carboxylic acids that can be used, the following are preferred: formic acid, acetic acid, as well as mixtures of formic acid and acetic acid, mixtures of formic acid and glycolic acid and mixtures of formic acid and oxalic acid.

Preferred alcohols that may be used are those having a boiling point in excess of 100° C., such as the linear or branched aliphatic monohydric alcohols containing from 4 to 10 carbon atoms, such as isobutanol, Alfol-6 (sold by CONDEA and containing 98.5% n-hexanol and having a distillation interval of 150°-170° C.), 2-ethyl hexanol, or the $C_8$-$C_{10}$ oxo alcohols. It is industrially advantageous to use those alcohols that are not miscible with water (that is to say, those whose solubility in water is less than 10% by weight at room temperature) because they can be recycled readily by simple decantation of the aqueous phase.

The amount of alcohol that preferably is used is a function of the linearity percentage of the "alkyl" radical or radicals. In particular, the higher the linearity percentage the greater the amount of alcohol that is most desirably used.

Suitable chloride ions may be added from a number of sources, including, for example, ammonium chloride, calcium chloride and zinc chloride.

Among the diluent oils that can be used are the paraffinic oils, such as 100 Neutral oil, as well as the naphthenic oils or mixed base lubricating oils (e.g., mixtures of a naphthenic oil and a paraffinic oil). Lubricating oils may be obtained by distilling a crude oil under vacuum. The resulting lubricating-oil fractions can then be further divided into distillate and residual lubricating oils. The resulting distillate oils, sometimes referred to as neutral oils, may be used as the diluent oil in my invention. A 100 Neutral oil has a Saybolt viscosity of 100 SSU at 100° F.

The amount of diluent oil that is preferably used is such that the amount of oil contained in the final product (including any diluent oil introduced with the alkylarylsulfonic acid) is from about 20 to about 60% by weight of that product, more preferably from about 25 to about 55% by weight of that product and most preferably from 30 to 40% by weight of that product.

In preferred processes of my invention:

(1) step (a) is conducted at a temperature of from about 20° to about 80° C. (most preferably from about 40° to about 70° C.) over a period of about 15 to 60 minutes (most preferably about 30 minutes);

(2) step (b) is conducted at atmospheric pressure at a temperature of from about 50° to about 120° C. (most preferably at a temperature of about 90°-110° C.) over a period of about 1 to 7 hours;

(3) step (c) is conducted either by:

(i) vacuum distilling the product contained in step (b) by gradually increasing the vacuum and heating the product until reaching a pressure of 4000 Pascal and a temperature of 195° C. and thereafter maintaining these conditions for about one hour; or (ii) heating the product obtained in step (b) at atmospheric pressure to 160° C., and thereafter vacuum distilling the product at 4000 Pascal on a thin-film evaporator whose wall temperature is 210°-220° C.

In embodiments of my invention that do not include the carbonation step described below, the detergent-dispersant additives obtained by the process of my invention have a TBN (Total Basic Number-ASTM Standard D 2896) that may range up to about 40. In such embodiments, the alkaline earth base/alkylarylsulfonic acid molar ratio used in step (a) is preferably between about 0.51 and about 1.3 (more preferably between about 0.55 and about 1.2).

Products having a higher TBN number (i.e., a TBN of up to about 100) can be obtained by using in step (a) a higher alkaline earth base/alkylarylsulfonic acid molar ratio (e.g., a molar ratio up to about 1.8, preferably up to about 1.6) and by carrying out a complementary carbonation step after step (b) and prior to step (c).

The carbonation step is advantageously carried out at a temperature between about 90° and about 180° C., preferably between about 110° and about 170° C., by introducing into the product obtained in step (b) an amount of $CO_2$ that is between that which can be completely absorbed by the reaction medium and about 30% in excess of that amount. If necessary, a mixture of water and alcohol is introduced toward or at the end of the carbonation to reduce the viscosity of the carbonated product to a value on the order of 100 to 600 cst at the temperature at which the carbonation step is being carried out.

The detergent-dispersant additives of my invention can advantageously be added to lubricating oils in an amount up to about 1.7% by weight for a gasoline engine oil; up to about 3.5% by weight for a diesel or marine engine oil; and up to about 11.5% by weight for a protective oil.

The lubricating oils in which my detergent-dispersant additives may be utilized may be chosen from among highly varied lubricating oils, such as the naphthenic base, paraffinic base and mixed-base lubricating oils, other hydrocarbon-based lubricants, for instance lubricating oils derived from coal products, and synthetic oils, for instance alkylene polymers, alkylene oxide-type polymers and their derivatives, including the alkylene oxide polymers prepared by polymerizing alkylene oxide in the presence of water or alcohols, for instance ethyl alcohol, the esters of dicarboxylic acids, liquid esters of phosphorous acids, alkylbenzenes and diakylbenzenes, polyphenyls, alkyl biphenyl ethers, and silicon polymers.

Supplementary additives, in addition to my detergent-dispersants, may also be utilized in the lubricating oils. For example, antioxidant additives, anticorrosion additives, ashless dispersant additives, etc., may also be present.

The following examples present illustrative, but non-limiting, embodiments of the present invention.

EXAMPLES 1 to 15

Except as specifically indicated below, in each of Examples 1–15 the following general procedure was used:

1. 100 Neutral oil, lime, and a 10% by weight solution of SI 200 (an antifoam agent marketed by RHONE-POULENC) in dodecylbenzene was charged into a four-necked 4-liter reaction vessel. The resulting medium was heated to 60° C. Thereafter, a sulfonic acid solution marketed by ESSO under the designation AS107 was introduced over a period of 30 minutes. AS107 is an approximately 72% by weight solution of an about 75% branched chain alkylarylsulfonic acid in an oil. The alkylarylsulfonic acid used had a molecular weight of 468 and the sodium salt of the alkylarylsulfonic acid had a molecular weight of about 490. Therefore, the apparent molecular weight of a 72% by weight acid solution would be approximately 650 (468/0.72=650).

2. Water, a 36% by weight aqueous solution of $CaCl_2$, then formic acid, and finally 2-ethyl hexanol were introduced into the reaction medium. The medium was heated to and maintained at 100° C.

3. Water and alcohol were removed from the product resulting from step 2 by distilling the product in vacuo (4000 Pa) at 195° C. for one hour.

4. The product remaining after distillation was then filtered to remove solid substances from the product.

The amounts of reactants used in Examples 1–15, 17–18, 20–26, 28–32, and 34–39 are shown in Tables I to VIII below. Those tables also show certain characteristics of the products made in the Examples. The weights of the sulfonic acids and of "$CaCl_2$" listed in Tables I to VIII are the total weights of the solutions containing the sulfonic acids and calcium chloride that were utilized in the example.

TABLE I

| | Example | | | | |
|---|---|---|---|---|---|
| | 1 | 2 | 3 | 4 | 5 |
| AS 107 g | 1251 | 1251 | 1251 | 1251 | 1251 |
| Oil g | 549 | 549 | 549 | 549 | 549 |
| Lime g | 118 | 106 | 118 | 118 | 118 |
| SI 200 g | 1,2 | 1,2 | 0,12 | 0,12 | 0,12 |
| $CaCl_2$ g | 22 | 22 | 22 | 22 | 22 |
| $H_2O$ g | 46 | 60 | 46 | 46 | 46 |
| Formic acid g | 24 | 24 | 24 | 24 | 24 |
| Ethyl hexanol g | 0 | 0 | 200 | 200 | 200 |
| Duration (hrs.) | 7 | 7 | 7 | 1 h 30 | 4 |
| % Crude Sediment | 2,8 | 2,2 | 1,2 | 1,6 | 1,6 |
| % Filtered Sediment | 0,08 | 0,1 | 0,004 | 0,004 | 0,005 |
| Total Ca wt-% | 2,7 | 2,7 | 3,1 | 3,1 | 3,2 |
| Basic Ca wt-% | 0,51 | 0,5 | 0,88 | 0,86 | 0,91 |
| TBN | 14 | 14 | 25 | 24,5 | 25,4 |
| Viscosity cst* as is | 254 | 201 | | | |
| at 2.9% $Ca_t$** | | | 40 | 39 | 33 |
| Compatibility | not checked | not checked | good | good | good |
| Foaming | 60/40 | 70/40 | 0/0 | 0/0 | 0/0 |

*centistokes
**total calcium

TABLE II

| | Example | | | | |
|---|---|---|---|---|---|
| | 6 | 7 | 8 | 9 | 10 |
| AS 107 g | 1251 | 625 | 1251 | 1251 | 1251 |
| Oil g | 549 | 274,5 | 549 | 549 | 549 |
| Lime g | 118 | 77 | 118 | 118 | 118 |
| SI 200 g | 0,12 | 0,06 | 0,12 | 0,12 | 0,12 |
| $CaCl_2$ g | 22 | 14,3 | 28,6 | 11 | 44 |
| $H_2O$ g | 46 | 29,9 | 59,8 | 46 | 46 |
| Formic acid g | 24 | 15,6 | 0 | 24 | 24 |
| Ethyl hexanol g | 150 | 130 | 260 | 200 | 200 |
| Duration (hrs.) | 1 h 30 | 1 h 30 | 1 h 30 | 1 h 30 | 1 h 30 |
| % Crude Sediment | 1,8 | 4 | 2 | 1,6 | 1,2 |
| % Filtered Sediment | 0,005 | 0,004 | 0,008 | 0,002 | 0,01 |
| Total Ca wt-% | 3,03 | 3,5 | 2,8 | 2,99 | 3,31 |
| Basic Ca wt-% | 0,67 | 1,17 | 0,57 | 0,75 | 0,91 |
| TBN | 19 | 34 | 17 | 24 | 29 |
| Viscosity cst* as is | | | 248 | | |
| at 2.9% $Ca_t$** | 51,8 | 26,8 | | 69,6 | 32,2 |
| Compatibility | good | good | good | good | good |
| Foaming | 0/0 | 0/0 | 20/10 | 30/20 | 20/10 |

*centistokes
**total calcium

TABLE III

| | Example | | | |
|---|---|---|---|---|
| | 11 | 12 | 13 | 14 |
| AS 107 g | 1251 | 1251 | 1251 | 1251 |
| Oil g | 549 | 549 | 549 | 549 |
| Lime g | 118 | 106 | 106 | 118 |
| SI 200 g | 0,12 | 0,12 | 0,12 | 0,12 |
| $CaCl_2$ g | 22 | 28,6 | 0 | 61 |
| $H_2O$ g | 46 | 60 | 54 | 46 |
| Formic acid g | 8 | 31,2 | 21,6 | 24 |
| Ethyl hexanol g | 200 | 260 | 180 | 200 |
| Duration (hrs.) | 1 h 30 | 1 h 30 | 1 h 30 | 1 h 30 |
| % Crude Sediment | 2 | 1,8 | 1,6 | 1,2 |
| % Filtered Sediment | 0,008 | 0,004 | 0,05 | 0,02 |
| Total Ca wt-% | 3 | 2,9 | 2,8 | 3,3 |
| Basic Ca wt-% | 0,73 | 0,54 | 0,51 | 0,95 |
| TBN | 22 | 17 | 16 | 30 |
| Viscosity cst* as is | | 134 | 800 | |
| at 2.9% $Ca_t$** | 22,5 | | | 30 |
| Compatibility | good | good | not | good |

TABLE III-continued

| | Example | | | |
|---|---|---|---|---|
| | 11 | 12 | 13 | 14 |
| Foaming | 20/10 | 40/20 | checked 150/60 | 0/0 |

*centistokes
**total calcium

TABLE IV

| | Example | | | | |
|---|---|---|---|---|---|
| | 15 | 17 | 18 | 20 | 21 |
| AS 107 g | 1251 | 1251 | 1251 | 1251 | 1251 |
| Oil g | 549 | 549 | 864 | 549 | 549 |
| Lime g | 118 | 118 | 79 | 118 | 106 |
| SI 200 g | 0,12 | 0,12 | 0,12 | 0,12 | 0,12 |
| $CaCl_2$ g | 22 | 22 | 22 | 22 | 19,8 |
| $H_2O$ g | 46 | 46 | 46 | 46 | 41,4 |
| Formic acid g | 24 | 24 | 2,3 | | 16,2 |
| Acetic acid | | | | 10 | 7 |
| Ethyl hexanol g | 350 | 200 | 200 | 200 | 180 |
| Duration (hrs.) | 1 h 30 | 1 h 30 | 1 h 30 | 1 h 30 | 2 h 30 |
| % Crude Sediment | 2 | 1,8 | 0,6 | 2 | 0,6 |
| % Filtered Sediment | 0,004 | 0,005 | 0,004 | 0,004 | 0,005 |
| Total Ca wt-% | 2,9 | 3 | 2,5 | 3 | 3,10 |
| Basic Ca wt-% | 0,61 | 0,65 | 0,11 | 0,81 | 0,85 |
| TBN | 20 | 19 | 8 | 23 | 25 |
| Viscosity cst* | | | | | |
| as is | | | 76,7 | | |
| at 2.9% $Ca_t$** | 40 | 51 | | 89 | 67 |
| Compatibility | good | good | good | good | good |
| Foaming | 0/0 | 0/0 | 20/10 | 20/10 | 0/0 |

*centistokes
**total calcium

TABLE V

| | Example | | | | |
|---|---|---|---|---|---|
| | 22 | 23 | 24 | 25 | 26 |
| AS 107 g | 1251 | 1251 | 1251 | 1251 | 1251 |
| Oil g | 549 | 549 | 549 | 549 | 549 |
| Lime g | 118 | 118 | 118 | 118 | 106 |
| SI 200 g | 0,12 | 0,12 | 0,12 | 0,12 | 0,12 |
| $CaCl_2$ g | 22 | 22 | 22 | 22 | |
| $NH_4Cl$ g | | | | | 3,4 |
| $H_2O$ g | 46 | 46 | 46 | 46 | 54 |
| Formic acid g | 24 | 24 | 24 | 24 | 21,6 |
| Alcohol g | IB/$A_6$ | IB | $A_6$ | OXO | |
| Ethyl hexanol g | | | | | 180 |
| Duration (hrs.) | 7 | 1 h 30 | 7 | 1 h 30 | 1 h 30 |
| % Crude Sediment | 1,6 | 1,6 | 4 | 1,4 | 1,6 |
| % Filtered Sediment | 0,005 | 0,005 | 0,005 | 0,02 | 0,005 |
| Total Ca wt-% | 3,01 | 3,3 | 3,36 | 3,15 | 2,9 |
| Basic Ca wt-% | 0,82 | 0,96 | 1,03 | 0,86 | 0,61 |
| TBN | 23 | 33,5 | 32 | 28 | 20 |
| Viscosity cst* | | | | | |
| as is | | | | | |
| at 2.9% $Ca_t$** | 49 | 33 | 30,6 | 36 | 41 |
| Compatibility | good | good | good | good | good |
| Foaming | 0/0 | 0/0 | 0/0 | 0/0 | 30/20 |

IB = isobutanol ; $A_6$ = Alfol $_6$ ; OXO = $C_8$ oxo alcohol.
*centistokes
**total calcium

TABLE VI

| | Example | | | | |
|---|---|---|---|---|---|
| | 28 | 29 | 30 | 31 | 32 |
| AXS g | | | | 938 | |
| Branched AS g | 889 | 407,1 | 407,1 | | |
| AS 107 g | 592,6 | 949,9 | 949,9 | | 1251 |
| Oil g | 318 | 443 | 443 | 862 | 549 |
| Lime g | 118 | 118 | 118 | 118 | 118 |
| SI 200 g | 0,12 | 0,12 | 0,12 | 0,12 | 0,12 |
| $CaCl_2$ g | 22 | 22 | 22 | 44 | 22 |
| $H_2O$ g | 46 | 46 | 46 | 100 | 46 |

TABLE VI-continued

| | Example | | | | |
|---|---|---|---|---|---|
| | 28 | 29 | 30 | 31 | 32 |
| Formic acid g | 24 | 24 | 24 | 24 | 24 |
| Ethyl hexanol g | 50 | 200 | 200 | 650 | 200 |
| Duration (hrs.) | 1 h 30 | 1 h 30 | 7 | 1 h 30 | 1 h 30 |
| % Crude Sediment | 2 | 1,8 | 1,6 | 2,5 | 2,4 |
| % Filtered Sediment | 0,004 | 0,006 | 0,006 | 0,004 | 0,04 |
| Total Ca wt-% | 3,1 | 3,02 | 3,15 | 2,8 | 2,8 |
| Basic Ca wt-% | 0,79 | 0,84 | 0,88 | 0,55 | 0,60 |
| TBN | 23 | 24 | 25 | 19 | 19 |
| Viscosity cst* | | | | | |
| as is | | | | 100 | 90 |
| at 2.9% $Ca_t$** | 40 | 41 | 36 | | |
| Compatibility | good | good | good | good | good |
| Foaming | 20/10 | 0/0 | 0/0 | 0/0 | 20/10 |

AXS = alkylxylene sulfonic acid
*centistokes
**total calcium

TABLE VII

| | Example | | | | |
|---|---|---|---|---|---|
| | 34 | 35 | 36 | 37 | 38 |
| Linear AS g | 328 | 301 | 610 | — | 949,9 |
| Branched AS g | 1546 | 1419 | 914 | 2083,8 | 407,1 |
| Oil g | 58 | 213 | 410 | 157,5 | 318 |
| Lime g | 118 | 118 | 118 | 135 | 201 |
| SI 200 g | 0,12 | 0,12 | 0,12 | 0,15 | 0,15 |
| $CaCl_2$ g | 23 | 23 | 23 | 27 | 22,5 |
| $H_2O$ g | 40,5 | 40,6 | 40,4 | 46 | 38,4 |
| Formic acid g | 7 | 7 | 7 | 9,3 | 9,4 |
| Acetic acid g | 7 | 7 | 7 | 9,3 | 9,4 |
| Ethyl hexanol g | 176 | 176 | 176 | 202,5 | 168 |
| Duration (hrs.) | 1 h 30 | 1 h 30 | 1 h 30 | 1 h 30 | 1 h 30 |
| % Crude Sediment | 0,2 | 0,2 | 0,8 | 0,8 | 1,2 |
| % Filtered Sediment | 0,002 | 0,002 | 0,02 | 0,05 | 0,04 |
| Total Ca wt-% | 3,32 | 3,14 | 3,05 | 3,01 | 5,33 |
| Basic Ca wt-% | 0,78 | 0,74 | 0,73 | 0,8 | 3,18 |
| TBN | 23 | 22 | 21 | 23,9 | 90,5 |
| Viscosity cst* | | | | | |
| as is | | | | | 610 |
| at 2.9% $Ca_t$** | 47,2 | 41,5 | 66 | 44,9 | |
| Compatibility | good | good | good | good | good |
| Foaming | 10/0 | 10/0 | 10/0 | 20/0 | 10/0 |

*centistokes
**total calcium

TABLE VIII

| | Example 39 |
|---|---|
| AS 107 g | 1007,2 |
| Branched AS g | 431,6 |
| Oil g | 350 |
| MgO g | 61 |
| SI 200 g | 0,12 |
| $CaCl_2$ g | 19,6 |
| $H_2O$ g | 40 |
| Formic acid g | 6,4 |
| Acetic acid g | 6,4 |
| Ethyl hexanol | 162 |
| Duration (hrs.) | 1 h 30 |
| % Crude Sediment | 0,5 |
| % Filtered Sediment | 0,008 |
| Total Mg wt-% | 1,74 |
| Basic Mg wt-% | 0,32 |
| TNB | 18,2 |
| Viscosity cst* as is | 64,5 |
| Compatibility | good |
| Foaming | 20/0 |

*centistokes

As can be seen from Table II, formic acid was not used in Example 8. The resulting product was slightly viscous and the reaction was less than complete. However, despite these disadvantages, I believe that the process of Example 8 could be carried out on an industrial scale.

Examples 1 and 2 are comparative examples in that they were carried out without utilizing an alcohol (2-ethyl hexanol) in the second step. In these examples, it was found that it was necessary to carry out the third step (the distillation step) in the presence of a very large amount of antifoam agent to prevent the formation of excessive amounts of foams which bring about entrainments when vacuum is applied. Because of this disadvantage, it is believed that the industrial extrapolation of the process described in Examples 1 and 2 would be impracticable.

Example 13 was also a comparative example in that it was carried out without utilizing calcium chloride as a source of chloride ion in the second step. The product formed in the second step in this example could be distilled, but it was difficult to filter the distilled product because of its high viscosity.

The characteristics of the products made in the examples, as reported in Tables I–VIII, were determined by the following procedures:

Viscosity (in cst)

In most cases, the viscosity was measured at 100° C. after first diluting the product in 100N oil until a solution having a total calcium content of 2.9% was obtained. When the product had a total calcium content below 2.9%, the viscosity was measured at 100° C. as is.

Compatibility

Monosuccinimide, zinc dithiophosphate-based additives were prepared. Each additive that was prepared contained about 75% by weight of the product made in the example. The resulting additive was added to 350 Neutral CFR basic oil having a Saybolt viscosity of 350 SSU at 100° F. (sold by Compagnie Francaise du Raffinage) to obtain a solution containing 10% by weight of the additive. The appearance of the resulting solution was studied after thirty days.

Foaming

The additive that was prepared for the compatibility test was subjected to step 1 of the ASTM test D892 at 24° C., carried out in a viscous SAE 50 oil.

EXAMPLE 16

Example 4 was repeated, except that step 2 was carried out at a temperature of 110° C. instead of 100° C. The results obtained were equivalent to those obtained in Example 4.

EXAMPLE 17

Example 4 was repeated, except that step 2 was carried out at a temperature of 85° C. instead of 100° C. The results obtained are shown in Table IV.

EXAMPLE 18

In this Example, an alkylbenzene sulfonate having a low TBN (equal to 8) was prepared. The amounts of reactants used and the results obtained are shown in Table IV.

EXAMPLE 19

Example 4 was repeated, except that 2-ethyl hexanol was added before the water in the second step. The results obtained were equivalent to those obtained in Example 4.

EXAMPLES 20–21

The general procedure described for Examples 1–15 was carried out except that formic acid was replaced by acetic acid (in Example 20), or by a formic acid/acetic acid mixture (in Example 21). The quantities of the reactants used and the results that were obtained are shown in Table IV.

EXAMPLES 22–25

The general procedure described for Examples 1–15 was carried out, except that the 2-ethyl hexanol was replaced by 200 g of the alcohols indicated in Table V. In that Table, "IB/$A_6$" refers to a 60:40 by weight mixture of isobutanol and Alfol-6. The quantities of the reactants used and the results that were obtained are shown in Table V.

EXAMPLES 26 and 27

Example 4 was repeated, except that the 22 g of the 36% $CaCl_2$ solution was replaced with:

In example 26, 3.4 g of $NH_4Cl$ and 54 g of water—the results that were obtained are shown in Table V.

In example 27, 10 g of $ZnCl_2$ and 58 g of water—the results that were obtained were equivalent to those obtained in Example 4.

EXAMPLE 28

The general procedure described for Examples 1–15 was carried out except that a mixture of alkylarylsulfonates was utilized, namely AS 107 and the product identified as "Branched AS g" in Table VI. The latter product comprised a 50% by weight solution of a totally branched alkylbenzenesulfonic acid (consisting of about 72% by weight of monoalkylbenzenesulfonic acid and about 28% by weight dialkylbenzenesulfonic acid) in an oil. The sodium salt of the totally branched alkylbenzene sulfonic acid had a molecular weight of about 420, which corresponds to an apparent molecular weight of the acid solution of about 800. The branched product was obtained by the sulfonation of the heavy fractions resulting from the alkylation of benzene by a propylene tetramer. The percentage of branching of the mixture was approximately 90%.

The amounts of reactants that were added and the results that were obtained are shown in Table VI.

EXAMPLE 29

Example 28 was repeated, except that a 70:30 by weight mixture of AS 107 and branched AS g was used. The percentage of branching was approximately 82.5%.

The amounts of reactants that were used and the results that were obtained are shown in Table VI.

EXAMPLE 30

The ethyl hexanol from the distillate that was obtained in Example 29 was separated from the remainder of the distillate by decantation, and was then recycled into a reaction medium having the same amounts of constituents utilized in the second step of Example 29 (See also the general procedure described for Examples 1–15). The third and fourth steps in the general procedure for Examples 1–15 were also conducted.

The results that were obtained are shown in Table VI.

EXAMPLE 31

The general procedure described for Examples 1–15 was carried out, except that an alkylorthoxylenesulfonic acid derived from a linear polyalphaolefin containing 18 carbon atoms (an approximately 95% solution in an oil) was utilized in place of AS 107. The molecular weight of the acid that was used (and that is identified as "AXS" in Table VI) was approximately 460.

The amounts of reactants that were used and the results that were obtained are shown in Table VI.

EXAMPLE 32

Example 4 was repeated, except that the $CaCl_2$ solution and the 2-ethyl hexanol were introduced in the first step of the process instead of the second step. The results obtained are shown in Table VI.

EXAMPLE 33

Example 21 was repeated, except that the acetic acid was replaced by the same weight of glycolic acid. Equivalent results were obtained.

EXAMPLE 34

The general procedure described for Examples 1–15 was carried out, except that a mixture of the 50% solution of totally branched alkylbenzenesulfonic acid used in Example 28 and an 85% solution of a fully linear alkylbenzenesulfonic acid (identified as "Linear AS g" in Table VII) were utilized. The latter was obtained by sulfonation of a mixture of 90% linear $C_{20}$–$C_{24}$ olefins and 10% linear $C_{24}$–$C_{28}$ olefins. The sodium salt of the fully linear alkylbenzenesulfonic acid had a molecular weight of approximately 490, which corresponds to an apparent molecular weight of the acid solution of about 550.

The amounts of reactants that were used and the results that were obtained are shown in Table VII.

EXAMPLES 35–36

The same general procedure described for Examples 1–15 was carried out, except that a mixture of the 50% solution of totally branched alkylbenzenesulfonic acid used in Example 28 and an 85% solution of a predominantly linear alkylbenzenesulfonic acid (identified as "Linear AS g" in Table VII) were utilized. The latter was obtained by sulfonation of a mixture of $C_{18}$–$C_{24}$ olefins. The sodium salt of the predominantly linear alkylbenzenesulfonic acid had a molecular weight of approximately 480, which corresponds to an apparent molecular weight of the acid solution of about 540.

The amounts of reactants that were used and the results that were obtained are shown in Table VII.

EXAMPLE 37

The same general procedure described for Examples 1–15 was carried out, except that the 50% solution of totally branched alkylbenzene sulfonic acid used in Example 28 was utilized. The amounts of reactants that were used and the results that were obtained are shown in Table VII.

EXAMPLE 38

An overbased alkylbenzenesulfonate was prepared from the 70:30 by weight mixture of sulfonic acids used in Example 29.

The first two steps of the general procedure described for Examples 1–15 were carried out, except that the reactants listed in Table VII were utilized. The product obtained was then carbonated for 60 minutes at 100° C. by means of 42 g of $CO_2$. A mixture of 52 g of water and of 178 g of 2-ethyl hexanol was then added and the medium was maintained at 100° C. for 45 minutes. The medium was distilled in vacuo (4000 Pa) at 195° C. for one hour and then filtered.

The results that were obtained are shown in Table VII.

EXAMPLE 39

The same general procedure described for Examples 1–15 was carried out, except that the 70:30 by weight mixture of sulfonic acids used in Example 29 was utilized and MAGLITE DE (active magnesium oxide) was substituted for the lime.

The amounts of reactants that were used and the results that were obtained are shown in Table VIII.

I claim:

1. A detergent-dispersant additive for lubricating oils made by a process comprising the following steps:
   (a) reacting in a diluent oil an alkylarylsulfonic acid with an alkaline earth base, the amounts of reactants used being such that the molar ratio of the alkaline earth base to the alkyl aryl sulfonic acid in the reaction medium is between about 0.51 and about 1.8;
   (b) contacting the materials specified in step (a), or their reaction product, with one or more linear or branched aliphatic monohydric alcohols having from 4 to 10 carbon atoms in the presence of water and chloride ions, with the molar ratios of the constituents being:
      (i) for the chloride ion to the alkylarylsulfonic acid, between about 0.005 and about 0.2;
      (ii) for the alcohol to the alkylarylsulfonic acid, greater than or equal to about 0.1; and
      (iii) for the water to the alkylarylsulfonic acid, between about 0.2 and about 5;
   (c) removing water and alcohol from the product obtained in step (b); and
   (d) removing solid substances from the product obtained in step (c).

2. The additive of claim 1, wherein the product obtained in step (d) contains about 20% to about 60% by weight of diluent oil.

3. The additive of claim 1, wherein the molar ratios of the constituents used in steps (a) and (b) are:
   (i) for the alkaline earth base to the alkylarylsulfonic acid, between about 0.55 and about 1.6;
   (ii) for the chloride ion to the alkylarylsulfonic acid, between about 0.01 and about 0.15;
   (iii) for the alcohol to the alkylarylsulfonic acid, between about 0.15 and about 2.5; and
   (iv) for the water to the alkylarylsulfonic acid, between about 0.5 and about 4.

4. The additive of claim 1, wherein the alkaline earth base is lime or active magnesium oxide.

5. The additive of claim 1, wherein the alcohol has a boiling point above about 100° C.

6. The additive of claim 5, wherein the alcohol is 2-ethyl hexanol.

7. The additive of claim 1, wherein the carboxylic acid is formic acid, acetic acid, a mixture of formic acid and acetic acid, a mixture of formic acid and glycolic acid or a mixture of formic acid and oxalic acid.

8. The additive of claim 1, wherein the chloride ions are introduced in the form of calcium chloride, ammonium chloride or zinc chloride.

9. The additive of claim 1, wherein step (c) is carried out at a temperature of about 20° to about 80° C. and step (b) is carried out at a temperature of about 50° to about 120° C.

10. The additive of claim 1, wherein the product obtained in step (b) is carbonated by means of $CO_2$ prior to the removal of the water and the alcohol in step (c).

11. The additive of claim 10, wherein the product is carbonated at a temperature of about 90° to about 180° C. by introducing an amount of $CO_2$ that is between that which is completely absorbed by the reaction medium and an amount that is 30% in excess of the amount that is absorbed.

12. The additive of claim 1 wherein step (b) is carried out in the presence of a carboxylic acid having from 1 to 4 carbon atoms, the carboxylic acid being added in an amount such that the molar ratio of the carboxylic acid to the basic alkaline earth base is less than about 2.

13. The additive of claim 12 wherein the molar ratio of the carboxylic acid to the basic alkaline earth base is between about 0.105 a%d about 1.5.

14. A lubricating oil containing an effective amount of the detergent-dispersant additive of claim 1.

15. A process for making a detergent-dispersant additive comprising the steps of:

(a) reacting in a diluent oil an alkylarylsulfonic acid with an alkaline earth base, the amounts of reactants used being such that the molar ratio of the alkaline earth base to the alkyl aryl sulfonic acid in the reaction medium is between about 0.51 and about 1.8;

(b) contacting the materials specified in step (a), or their reaction product, with one or more linear or branched aliphatic monohydric alcohols having from 4 to 10 carbon atoms in the presence of water and chloride ions, with the molar ratios of the constituents being:

(i) for the chloride ion to the alkylarylsulfonic acid, between about 0.005 and about 0.2;

(ii) for the alcohol to the alkylarylsulfonic acid, greater than or equal to about 0.1; and (iii) for the water to the alkylarylsulfonic acid, between about 0.2 and about 5;

(c) removing water and alcohol from the product obtained in step (b); and (d) removing solid substances from the product obtained in step (c).

16. The process of claim 15, wherein said solid substances are removed by filtration.

17. The process of claim 15, wherein the molar ratios of the constituents used in steps (a) and (b) are:

(i) for the alkaline earth base to the alkylarylsulfonic acid, between about 0.55 and about 1.6;

(ii) for the chloride ion to the alkylarylsulfonic acid, between about 0.01 and about 0.15;

(iii) for the alcohol to the alkylarylsulfonic acid, between about 0.15 and about 2.5; and (iv) for the water to the alkylarylsulfonic acid, between about 0.5 and about 4.

18. The process of claim 15, wherein the alkaline earth base is lime or active magnesium oxide.

19. The process of claim 15, wherein the alcohol has a boiling point above about 100° C.

20. The process of claim 19, wherein the alcohol is 2-ethyl hexanol.

21. The process of claim 15, wherein the chloride ions are introduced in the form of calcium chloride, ammonium chloride or zinc chloride.

22. The process of claim 15, wherein step (c) is carried out at a temperature of about 20° to about 80° C. and step (b) is carried out at a temperature of about 50° to about 120° C.

23. The process of claim 15, wherein the product obtained in step (b) is carbonated by means of $CO_2$ prior to the removal of the water and the alcohol in step (c).

24. The process of claim 21, wherein the product is carbonated at a temperature of about 90° to about 180° C. by introducing an amount of $CO_2$ that is between that which is completely absorbed by the reaction medium and an amount that is 30% in excess of the amount that is absorbed.

25. The process of claim 15, wherein step (b) is carried out in the presence of a carboxylic acid having from 1 to 4 carbon atoms, the carboxylic acid being added in an amount such that the molar ratio of the carboxylic acid to the basic alkaline earth base is less than about 2.

26. The process of claim 25 wherein the molar ratio of the carboxylic acid to the basic alkaline earth base is between about 0.105 and about 1.5.

27. The process of claim 25, wherein the carboxylic acid is formic acid, acetic acid, a mixture of formic acid and acetic acid, a mixture of formic acid and glycolic acid, or a mixture of formic acid and oxalic acid.

* * * * *